US005370988A

United States Patent [19]

Manganiello et al.

[11] Patent Number: 5,370,988

[45] Date of Patent: Dec. 6, 1994

[54] PRINT STABILIZERS AND ANTIFOGGANTS FOR PHOTOTHERMOGRAPHY

[75] Inventors: Frank J. Manganiello, St. Paul; Kumars Sakizadeh, Woodbury, both of Minn.

[73] Assignee: Minnesota Mining and Manufacturing Company, St. Paul, Minn.

[21] Appl. No.: 203,121

[22] Filed: Feb. 28, 1994

[51] Int. Cl.[5] ..... G03C 1/498

[52] U.S. Cl. ..... 430/619; 430/600; 430/607; 430/613

[58] Field of Search ..... 430/619, 607, 613, 600

[56] References Cited

U.S. PATENT DOCUMENTS

| | | | |
|---|---|---|---|
| 3,794,493 | 2/1974 | Sobel et al. | 96/84 R |
| 4,137,079 | 1/1979 | Houle | 96/55 |
| 4,245,033 | 1/1981 | Eida et al. | 430/353 |
| 4,378,424 | 3/1983 | Altand et al. | 430/352 |
| 4,396,712 | 8/1983 | Kinoshita et al. | 430/614 |
| 4,451,561 | 5/1984 | Hirabayashi et al. | 430/619 |
| 4,837,141 | 6/1989 | Kohno et al. | 430/559 |
| 5,084,570 | 1/1992 | Burdeska et al. | 544/216 |
| 5,200,307 | 4/1993 | Takahashi | 430/507 |
| 5,215,856 | 6/1993 | Jayaraman | 430/165 |
| 5,234,791 | 8/1993 | Dammel et al. | 430/270 |

FOREIGN PATENT DOCUMENTS

| | | |
|---|---|---|
| 0443820A2 | 2/1991 | European Pat. Off. . |
| 0496640A1 | 1/1992 | European Pat. Off. . |
| 0530135A1 | 5/1992 | European Pat. Off. . |
| 3821585A1 | 3/1989 | Germany . |
| 61011741A2 | 1/1986 | Japan . |
| 59158289A2 | 9/1986 | Japan . |
| 62-136641A2 | 6/1987 | Japan . |
| 01164940A2 | 6/1989 | Japan . |
| 01170942A2 | 7/1989 | Japan . |
| 01177029A2 | 7/1989 | Japan . |
| 04011260A2 | 1/1992 | Japan . |
| 03163568A2 | 7/1992 | Japan . |
| 04301850A2 | 10/1992 | Japan . |
| 04367864A2 | 12/1992 | Japan . |
| 1287770 | 12/1969 | United Kingdom . |

*Primary Examiner*—Thorl Chea

*Attorney, Agent, or Firm*—Gary L. Griswold; Walter N. Kirn; Susan Moeller Zerull

[57] ABSTRACT

The present invention is a heat developed, photothermographic element comprising a support bearing at least one photosensitive, image-forming photothermographic emulsion layer comprising:

(a) a photosensitive silver halide;

(b) a non-photosensitive, reducible silver source;

(c) a reducing agent for silver ions;

(d) a binder; and (e) a substituted hydroxyphenyl compound which provides antifoggant and print stabilizing properties to the photothermographic element. The substituted hydroxyphenyl compound may be of the formula:

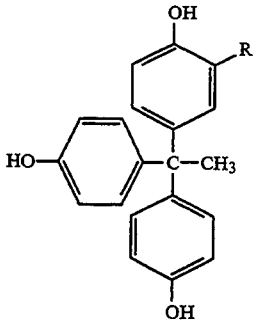

wherein:

R represents hydrogen, benzoyl, a five or six membered heterocyclic ring system, or a fused ring system; or of the formula

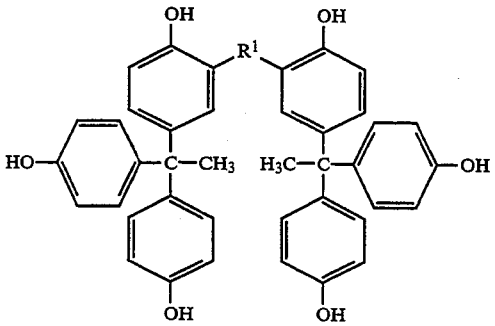

wherein:

$R^1$ represents a disubstituted or a trisubstituted s-triazine group, a disubstituted benz-bis-triazole group, a disubstituted benz-bis-thiazole group, a disubstituted benz-bis-oxazole group, and a disubstituted benz-bis-imidazole group.

8 Claims, No Drawings

PRINT STABILIZERS AND ANTIFOGGANTS FOR PHOTOTHERMOGRAPHY

BACKGROUND OF THE INVENTION

1. Field of Invention

This invention relates to a photothermographic silver halide element and in particular to shelf-life and post-processing stabilization of photothermographic silver containing elements.

2. Background to the Art

Silver halide-containing, photothermographic imaging materials (i.e., heat-developable photographic materials) processed with heat, and without liquid development, have been known in the art for many years. These materials, also known as "dry silver" compositions or emulsions, generally comprise a support having coated thereon: (1) a photosensitive material that generates atomic silver when irradiated, (2) a non-photosensitive, reducible silver source, (3) a reducing agent for the non-photosensitive, reducible silver source, and (4) a binder. The photosensitive material is generally photographic silver halide which must be in catalytic proximity to the non-photosensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that elemental silver ($Ag^{\circ}$) is a catalyst for the reduction of silver ions, and a progenitor of the photosensitive photographic silver halide may be placed into catalytic proximity with the non-photosensitive, reducible silver source in a number of different fashions, such as by partial metathesis of the reducible silver source with a halogen-containing source (see, for example, U.S. Pat. No. 3,457,075), coprecipitation of silver halide and reducible silver source material (see, for example, U.S. Pat. No. 3,839,049), and other methods that intimately associate the photosensitive photographic silver halide and the non-photosensitive, reducible silver source.

The non-photosensitive, reducible silver source is a material that contains silver ions. The preferred non-photosensitive reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates, have been proposed, and U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image generally is not visible by ordinary means and the photosensitive emulsion must be further processed in order to produce a visible image. The visible image is produced by the reduction of silver ions, which are in catalytic proximity to silver halide grains bearing the clusters of silver atoms, i.e. the latent image. This produces a black and white image.

As the visible image is produced entirely by elemental silver ($Ag^{\circ}$), one cannot readily decrease the amount of silver in the emulsion without reducing the maximum image density. However, reduction of the amount of silver is often desirable in order to reduce the cost of raw materials used in the emulsion.

One conventional way of attempting to increase the maximum image density of photographic and photothermographic emulsions without increasing the amount of silver in the emulsion layer is by incorporating dye-forming materials in the emulsion. Color images can be formed by incorporation of leuco dyes into the emulsion. Leuco dyes are the reduced form of a color-bearing dye. Upon imaging, the leuco dye is oxidized, and the color-bearing dye and a reduced silver image are simultaneously formed in the exposed region. In this way, a dye enhanced silver image can be produced, as shown, for example, in U.S. Pat. Nos. 3,351,286; 4,187,108; 4,426,441, 4,374,921; and 4,460,681.

Multicolor photothermographic imaging elements typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsions layer. Photothermographic elements having at least 2 or 3 distinct color-forming emulsion layers are disclosed in U.S. Pat. Nos. 4,021,240 and 4,460,681. Various methods to produce dye images and multicolor images with photographic color couplers and leuco dyes are well know in the art as represented by U.S. Pat. Nos. 4,022,617; 3,531,286; 3,180,731; 3,761,270; 4,460,681; 4,883,747; and *Research Disclosure*, March 1989, item 29963.

One common problem that exists with photothermographic systems is the instability of the image following processing. The photo active silver halide still present in the developed image may continue to catalyze print-out of metallic silver during room light handling. Thus, there exists a need for stabilization of the unreacted silver halide. The addition of separate post-processing image stabilizers or stabilizer precursors provides the desired post-processing stability. Most often these are sulfur-containing compounds such as mercaptans, thiones, and thioethers as described in Research Disclosure 17029. U.S. Pat. No. 4,245,033 describes sulfur compounds of the mercapto-type that are development restrainers of photothermographic system. See also U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles, such as 3-amino-5-benzothio-1,2,4-triazole, used as post-processing stabilizers are described in U.S. Pat. Nos. 4,128,557; 4,137,079; 4,138,265; and *Research Disclosure* 16977 and 16979.

Thus, there has been a continued need for improved post-processing stabilizers that do not fog or desensitize the photographic materials, and stabilizer precursors that release the stabilizing moiety at the appropriate time and do not have any detrimental effects on the photosensitive material or user of the material.

SUMMARY OF THE INVENTION

The present invention provides heat-developable, photothermographic elements which are capable of providing high photographic speed; stable, high density images of high resolution and good sharpness; and good shelf stability.

The heat-developable, photothermographic elements of the present invention comprise a support bearing at least one photosensitive, image-forming photothermographic emulsion layer comprising:

(a) a photosensitive silver halide;
(b) a non-photosensitive, reducible silver source;
(c) a reducing agent for silver ions;
(d) a binder; and
(e) a substituted hydroxyphenyl compound having a nucleus of the formula

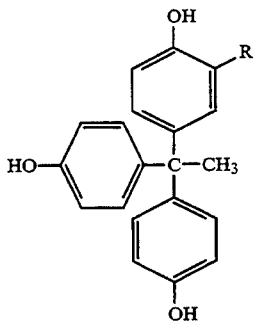

wherein:

R represents hydrogen, a benzoyl group, a five or six membered heterocyclic ring group, or a fused ring group such as benzotriazole, benzoxazole, benzothiazole, benzimidazole, pyridine, benzopyridine, pyrimidine, or s-triazine.

In another preferred embodiment the heat-developable, photothermographic elements of the present invention comprise a support bearing at least one photosensitive, image-forming photothermographic emulsion layer comprising:

(a) a photosensitive silver halide;
(b) a non-photosensitive, reducible silver source;
(c) a reducing agent for silver ions;
(d) a binder; and
(e) a substituted hydroxyphenyl compound having a nucleus of the formula

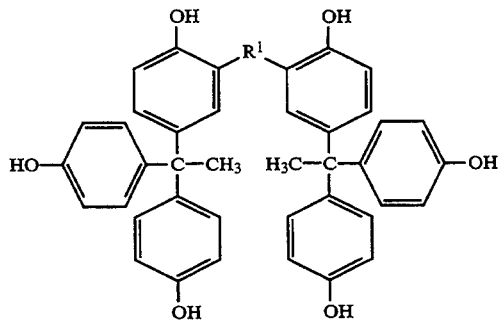

wherein:

$R^1$ represents a disubstituted or a trisubstituted s-triazine group, a disubstituted benz-bis-triazole group, a disubstituted benz-bis-thiazole group, a disubstituted benz-bis-oxazole group, and a disubstituted benz-bis-imidazole group.

The reducing agent for the reducible source of silver may be a compound that can be oxidized to form or release a dye.

The hydroxyphenyl compounds used in the practice of the present invention typically comprise from about 0.01 wt % to 10 wt % of the dry photothermographic composition. They may be incorporated directly into the silver containing layer or into an adjacent layer. The photothermographically useful materials of the invention are especially useful in elements and compositions for the preparation of photothermographic color and photothermographic black-and-white images.

A preferred use of compounds of this invention is as post-processing stabilizers for photothermographic materials. When so used, compounds of the invention provide improved post-processing image stability and antifoggant characteristics with little or no effect on initial sensitometry.

As used herein, the term "emulsion layer" means a layer of a photothermographic element that contains photosensitive silver salt and silver source material.

When a general structure is referred to as "a compound having the nucleus of" a given formula, any substitution which does not alter the bond structure of the formula or the shown atoms within that structure, is included within that structure. For example, where there is a polymethine chain shown between two defined heterocyclic nuclei, substituent groups may be placed on the chain or on the heterocyclic nucleus, but the conjugation of the chain may not be altered and the atoms shown in the heterocyclic nuclei may not be replaced.

When a general structure is referred to as "a general formula" it does not specifically allow for such broad substitution of the structure.

As is well understood in this area, substitution is not only tolerated, but is often advisable and substitution is anticipated on the compounds used in the present invention. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical compound or substituent, the described chemical material includes the basic group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents bearing further substituents known in the art, such as hydroxyl, alkoxy, vinyl, phenyl, halogen atoms (F, Cl, Br, and I), cyano, nitro, amino, carboxyl, etc. On the other hand, the phrase "alkyl moiety" is limited to the inclusion of only pure open-chain and cyclic saturated hydrocarbon alkyl substituents, such as methyl, ethyl, propyl, t-butyl, cyclohexyl, adamantyl, octadecyl, and the like. Substituents which react with active ingredients, such as very strongly electrophilic or oxidizing substituents, would of course be excluded by the ordinary skilled artisan as not being inert or harmless.

Other aspects, advantages, and benefits of the present invention are apparent from the detailed description, examples and claims.

DETAILED DESCRIPTION OF THE INVENTION

The present invention provides heat-developable, photothermographic elements capable of providing stable, high density images of high resolution.

In one preferred embodiment, these heat-developable, photothermographic elements comprise a support bearing at least one photosensitive, image-forming photothermographic-emulsion layer comprising:

(a) a photosensitive silver halide;
(b) a non-photosensitive, reducible silver source;
(c) a reducing agent for silver ions;
(d) a binder; and
(e) a substituted hydroxyphenyl compound having a nucleus of the formula

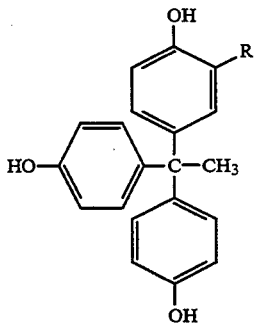

wherein:

R represents hydrogen, a benzoyl group, a five or six membered heterocyclic ring group, or a fused ring group such as benzotriazole, benzoxazole, benzothiazole, benzimidazole, pyridine, benzopyridine, pyrimidine, or s-triazine.

In another preferred embodiment, these heat-developable, photothermographic elements comprise a support bearing at least one photosensitive, image-forming photothermographic-emulsion layer comprising:

(a) a photosensitive silver halide;
(b) a non-photosensitive, reducible silver source;
(c) a reducing agent for silver ions;
(d) a binder; and
(e) a substituted hydroxyphenyl compound having a nucleus of the formula

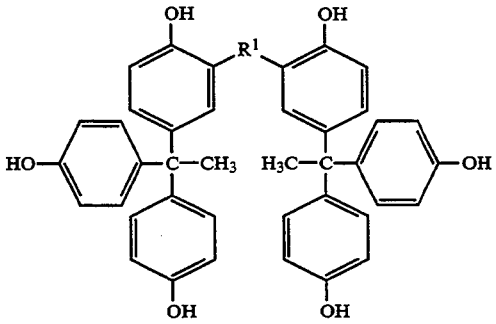

wherein:

$R^1$ represents a disubstituted or trisubstituted s-triazine group, a disubstituted benz-bis-triazole group, a disubstituted benz-bis-thiazole group, a disubstituted benz-bis-oxazole group, and a disubstituted benz-bis-imidazole group.

When used as post-processing stabilizers in photothermographic elements, the photothermographically useful materials of the invention may contain other post-processing stabilizers in combination with the compounds of the invention, as well as other additives in combination with the compound of the invention such as shelf-life stabilizers, toners, development accelerators, and other image-modifying agents.

The amounts of the above-described post-processing stabilizer ingredients that are added to the emulsion layer according to the present invention may be varied depending upon the particular compound used an upon the type of emulsion layer (i.e., black-and-while or color).

The photothermographic elements of this invention may be used to prepare black-and-white, monochrome, or full color images. The photothermographic material of this invention can be used, for example, in conventional black-and-white or color photothermography, in electronically generated black and white or color hard copy recording, in the graphic arts area, and in digital color proofing. The material of this invention provides high photographic speed, provides strongly absorbing black-and-white or color images, and provides a dry and rapid process.

The Photosensitive Silver Halide

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The light sensitive silver halide used in the present invention can be employed in a range of 0.005 mole to 0.5 mole and, preferably, from 0.01 mole to 0.15 mole per mole of non-photosensitive reducible silver salt.

The silver halide used in the present invention may be employed without modification. However, it can be chemically and spectrally sensitized in a manner similar to that used to sensitize conventional wet process silver halide or state-of-the-art heat-developable photographic materials. For example, it may be chemically sensitized with a chemical sensitizing agent such as a compound containing sulfur, selenium or tellurium etc., or a compound containing gold, platinum, palladium, ruthenium, rhodium or iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ moles per mole of silver halide.

The Non-Photosensitive Reducible Silver Source Material

The non-photosensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl-l,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkyl-thioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-l-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-l,2,4-thiazole, a silver salt of a thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen-substituted benzotriazole, such as a silver salt of 5-chloro-benzotriazole, etc., a silver salt of 1,2,4-triazole, of 1H-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* April 1983 (22812), *Research Disclosure* October 1983 (23419) and U.S. Pat. No. 3,985,565.

The silver halide may be pre-formed by any means, e.g., in accordance with U.S. Pat. No. 3,839,049. Methods of preparing these silver halide and organic silver salts and manners of blending them are described in Research Disclosures, No. 170-29, Japanese patent application Nos. 32928/75 and 42529/76, U.S. Pat. No. 3,700,458, and Japanese patent application Nos. 13224/74 and 17216/75.

Pre-formed silver halide emulsions in the material of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341. The silver halide grains may have any crystalline habit including, but not limited to, cubic, tetrahedral, orthorhombic, tabular, laminar, platelet, etc. The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio.

It is also effective to use an in situ process which comprises adding a halogen-containing compound to the organic silver salt to partially convert the silver of the organic silver salt to silver halide.

The silver halide and the non-photosensitive reducible silver source material that form a starting point of development should be in reactive association. By "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing preformed silver halide in accordance with this invention can be sensitized with chemical sensitizers, or with spectral sensitizers as described above.

The source of reducible silver material generally constitutes from 15 to 70 percent by weight of the emulsion layer. It is preferably present at a level of 30 to 55 percent by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionyl-β-phenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl α-cyano-2-methylphenylacetate, ethyl α-cyanophenylacetate; bis-o-naphthols as illustrated by 2,2'-dihydroxy-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g.,2,4-dihydroxybenzophenone or 2,4-dihydroxyacetophenone); 5-pyrazolones such as 3-methyl-1-phenyl-5-pyrazolone; reductones as illustrated by dimethylaminohexosereductone, anhydrodihydroaminohexose reductone, and anhydrodihydropiperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-l,4-dihydropyridine; bisphenols, e.g., bis(2-hydroxy-3-t-butyl-5-methyl phenyl) methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl)propane; 1,1-bis(2-hydroxy-3,5-dimethylphenyl)-3,5,5-trimethylhexane; ascorbic acid derivatives, e.g., 1-ascorbylpalmitate, ascorbylstearate and unsaturated aldehydes and ketones, such as benzyl and diacetyl; 3-pyrazolidones; and certain indane-1,3-diones.

The reducing agent should be present as 1 to 12 percent by weight of the imaging layer. In multilayer constructions, if the reducing agent is added to a layer other than an emulsion layer, slightly higher proportions, of from about 2 to 15 percent, tend to be more desirable.

The Optional Dye Releasing Material

As noted above, the reducing agent for the reducible source of silver may be a compound that can be oxidized to form or release a dye.

Leuco dyes are one class of dye releasing material that forms a dye upon oxidation. The optional leuco dye may be any colorless or lightly colored compound that can be oxidized to a colored form, when heated, preferably to a temperature of from about 80° C. to about 250° C. (176° F. to 482° F.) for a duration of from about 0.5 to about 300 seconds and can diffuse through emulsion layers and interlayers into the image receiving layer of the element of the invention. Any leuco dye capable of being oxidized by silver ion to form a visible image can be used in the present invention. Leuco dyes that are both pH sensitive and oxidizable can be used but are not preferred. Leuco dyes that are sensitive only to changes in pH are not included within scope of dyes useful in this invention because they are not oxidizable to a colored form.

As used herein, the term "change in color" includes (1) a change from an uncolored or lightly colored state (optical density less than 0.2) to a colored state (an increase in optical density of at least 0.2 units), and (2) substantial change in hue.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylene-diamine with a phenolic or anilinic compound. Leuco dyes of this class are described in U.S. Pat. No. 4,594,307. Leuco chromogenic dyes having short chain carbamoyl protecting groups are described in copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415; 4,570,171; 4,622,395; and 4,647,525.

Also useful are neutral, phenolic leuco dyes such as 2-(3,5-di-t-butyl-4-hydroxy-phenyl)-4,5,-diphenylimidazole, or bis(3,5-di-t-butyl-4-hydroxyphenyl) phenyl-methane. Other phenolic leuco dyes useful in practice of the present invention are disclosed in U.S. Pat. Nos. 4,374,921; 4,460,681; 4,594,307; and 4,782,010.

The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150 nm, and more preferably, by at least 200 nm. Any leuco dye capable of being oxidized by silver ion to form a visible dye is useful in the present invention as previously noted.

Other leuco dyes may be used in imaging layers as well, for example, benzylidene leuco compounds cited in U.S. Pat. No. 4,923,792, incorporated herein by reference. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ liter/mole-cm, and possess good compatibility and heat stability. The dyes are readily synthesized and the reduced leuco forms of the compounds are very stable. Leuco dyes such as those disclosed in U.S. Pat. Nos. 3,442,224; 4,021,250; 4,022,617; and 4,368,247 are also useful in the present invention.

The dyes generated by the leuco compounds employed in the elements of the present invention are known and are disclosed, for example, in *The Colour Index*; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; U.S. Pat. No. 4,478,927, and Hamer, F. M. *The Cyanine Dyes and Related Compounds*; Interscience Publishers: New York, 1964; p. 492.

Leuco dye compounds may readily be synthesized by techniques known in the art. Suitable methods are disclosed, for example, In: F. X. Smith et al. *Tetrahedron Lett.* 1983, 24(45), 4951–4954; X. Huang., L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2),343; and T. Sohda et al. *Chem. Pharm. Bull.* 1983, 31(2) 560–5; H. A. Lubs *The Chemistry of Synthetic Dyes and Pigments*; Hafner; New York, N.Y.; 1955 Chapter 5; in H. Zollinger *Color Chemistry: Synthesis, Properties and Applications of Organic Dyes and Pigments*; VCH; New York, N.Y.; pp. 67–73, 1987, and in U.S. Pat. No. 5,149,807; and EPO Laid Open Application No. 0,244,399.

Another class of dye releasing materials that form a dye upon oxidation are known as pre-formed-dye-release (PDR) or redox-dye-release (RDR) materials. In these materials the reducing agent for the organic silver compound releases a pre-formed dye upon oxidation. Examples of these materials are disclosed in Swain, U.S. Pat. No. 4,981,775.

Further, as other image forming materials, materials where the mobility of the compound having a dye part changes as a result of an oxidation-reduction reaction with silver halide, or an organic silver salt at high temperature can be used, as described in Japanese Patent Application No. 165054 (1984). Many of the above-described materials are materials wherein an imagewise distribution of mobile dyes corresponding to exposure is formed in the photosensitive material by heat development. Processes of obtaining visible images by transferring the dyes of the image to a dye fixing material (diffusion transfer) have been described in the above described cited patents and Japanese Patent Application Nos. 168,439 (1984) and 182,447 (1984).

Still further the reducing agent may be a compound that releases a conventional photographic dye coupler or developer on oxidation as is known in the art. When the heat developable, photosensitive material used in this invention is heat developed in a substantially water-free condition after or simultaneously with imagewise exposure, a mobile dye image is obtained simultaneously with the formation of a silver image either in exposed areas or in unexposed areas with exposed photosensitive silver halide.

The total amount of optional leuco dye used as a reducing agent utilized in the present invention should preferably be in the range of 0.5–25 weight percent, and more preferably in the range of 1–10 weight percent, based upon the total weight of each individual layer in which the reducing agent is employed.

The Binder

It is preferred that the binder be sufficiently polar to hold the other ingredients of the emulsion in solution. It is preferred that the binder be selected from polymeric materials, such as, for example, natural and synthetic resins, such as gelatin, polyvinyl acetals, polyvinyl chloride, polyvinyl acetate, celluloseacetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders can be used individually or in combination with one another. Although the binder may be hydrophilic or hydrophobic; it is preferably hydrophobic.

The binders are generally used at a level of from about 20 to about 80 percent by weight of the emulsion layer, and preferably from about 30 to about 55 percent by weight. Where the proportions and activities of the components require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally these polymers may be used in combination of two or more thereof. Such a polymer is used in an amount sufficient to carry the components dispersed therein, that is, within the effective range of the action as the binder. The effective range can be appropriately determined by one skilled in the art.

Dry Silver Formulations

The formulation for the photothermographic emulsion layer can be prepared by dissolving and dispersing the binder, the photosensitive silver halide, the non-photosensitive source of reducible silver, the reducing agent for the non-photosensitive reducible silver source (as, for example, the optional leuco dye), and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferably from 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl-)aryldicarboximides, e.g. (N,N-dimethylaminomethyl)phthalimide, and N-(dimethylaminomethyl)-naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diaza-octane)bis(isothiuronium)trifluoroacetate and 2-(tribromomethylsulfonyl benzothiazole); and merocyanine dyes such as 3-ethyl-5-[(3-ethyl-2-benzothiazolinylidene)-1-methylethylidene]-2-thio-2,4-oazolidinedione; phthalazine and phthalazine derivatives; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H,4H-2,3a,5,6a-tetraza-pentalene, and 1,4-di-(o-chlorophenyl)-3,6-dimercapto-1H,4H-2,3a,5,6a-tetrazapentalene.

Optionally, additional antifoggants and stabilizers may be used in combination with the hydroxy-phenyl antifoggant/stabilizer compounds of this invention. Suitable antifoggants and stabilizers which can be used include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915. It may also be advantageous to add mercury (II) salts to the emulsion layer(s) as an antifoggant. Preferred mercury (II) salts for this purpose are mercuric acetate and mercuric bromide.

Emulsions used in the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

Photothermographic elements can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton, U.S. Pat. No. 3,282,699.

Photothermographic elements can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Photothermographic emulsions can contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The photothermographic dry silver emulsions of this invention may be constructed of one or more layers on a substrate. Single layer constructions should contain the silver source material, the silver halide, the developer, and binder as well as optional materials such as toners, coating aids, and other adjuvants. Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic elements, the various emulsion layers are generally maintained distinct from each other by the use of functional or non-functional barrier layers between the various photosensitive layers as described in U.S. Pat. No. 4,460,681.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support or substrate can be selected from a wide range of materials depending on the imaging requirement. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an α-olefin polymer, particularly a polymer of an alpha-olefin containing 2 to 10 carbon atoms such as polyethylene, polypropylene, ethylene butene copolymers and the like. Preferred polymeric materials for the support include polymers having good heat stability, such as polyesters. A particularly preferred polyester is polyethylene terephthalate.

Photothermographic emulsions used in this invention can be coated by various coating procedures including, wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

The substrate with backside resistive heating layer may also be used in color photothermographic imaging systems such as shown in U.S. Pat. Nos. 4,460,681 and 4,374,921.

The Image-Receiving Layer

The photothermographic element may further comprise an image-receiving layer. Images derived from the photothermographic elements employing compounds capable of being oxidized to form or release a dye, as for example, leuco dyes are typically transferred to an image-receiving layer.

The image-receiving layer of this invention can be any flexible or rigid, transparent layer made of thermoplastic polymer. The image-receiving layer preferably has a thickness of at least 0.1 micrometer, more preferably from about 1 to about 10 micrometers, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as celluloseacetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably from 1.5 to 3.5) or a transmission optical density in the range of from 0.2 to 2.5 (preferably from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyesteris "Fluorad FC 431", (a fluorinated surfactant, available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated shoe-and-roller type heat processor.

Multi-layer constructions containing blue-sensitive emulsions containing a yellow dye forming or dye releasing compound may be overcoated with green-sensitive emulsions containing a magenta dye forming or dye releasing compound. These layers may in turn be overcoated with a red-sensitive emulsion layer containing a cyan forming or dye releasing compound. Imaging and heating form the yellow, magenta, and cyan images in an imagewise fashion. The dyes so formed may migrate to an image-receiving layer. The image-receiving layer may be a permanent part of the construction or may be removable "i.e., strippably adhered" and subsequently peeled from the construction. Color-forming layers may be maintained distinct from each other by the use of functional or non-functional barrier layers between the various photosensitive layers as described in U.S. Pat. No. 4,460,681. False color address, such as that shown in U.S. Pat. No. 4,619,892, may also be used rather than blue-yellow, green-magenta, or red-cyan relationships between sensitivity and dye formation.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Alternatively, a multi-colored image may be prepared by superimposing in register a single image-receiving sheet successively with two or more imagewise exposed photothermographic elements, each of which release a dye of a different color, and heating to transfer the released dyes as described above. This method is particularly suitable for the production of color proofs especially when the dyes released have hues which match the internationally-agreed standards for color reproduction (SWOP colors). Dyes with this property are disclosed in U.S. Pat. No. 5,023,229. In this embodiment, the photothermographic element preferably comprises compounds capable of being oxidized to release a pre-formed dye as this enables the image dye absorptions to be tailored more easily to particular requirements of the imaging system. When used in a photothermographic element, the elements are preferably all sensitized to the same wavelength range regardless of the color of the dye released. For example, the elements may be sensitized to ultra-violet radiation with a view toward contact exposure on conventional printing frames, or they may be sensitized to langer wavelengths, especially red or near infra-red to enable digital address by lasers.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

In the following examples, photothermographic imaging constructions are shown. The scope of the invention is not to be limited to the specific examples.

Acryloid TM A-21 is a poly(methyl methacrylate) available from Rohm and Hass, Philadelphia, Pa.

Butvar TM B-76 and Butvar TM B-79 are poly(vinyl butyral) resins available from Monsanto Company, St. Louis, Mo.

CA 398-6 is a cellulose acetate polymer available from Eastman Kodak Co., Rochester, N.Y.

CAB 171-15S is a cellulose acetate butyrate available from Eastman Kodak.

CAO-05 TM is an antioxidant purchased from Rohm and Haas Co., Philadelphia, Pa.

CBBA is 2-(4-chlorobenzoyl)benzoic acid.

MEK is methyl ethyl ketone (2-butanone).

MMBI is 5-methyl-2-mercaptobenzimidazole.

Nonox is 1,1-bis(2-hydroxy-3,5-dimethylphenyl)-3,5,5-trimethylhexane [CAS RN=7292-14-0]. It is also known as Permanax WSO.

PHP is pyridinium hydrobromide perbromide.

1,1,1,-Tris(4-hydroxyphenyl)ethane (THPE) was purchased from Aldrich Chemical Co., Milwaukee, Wis.

3-Benzotriazolyl-1',1',1'-tris(4-hydroxyphenyl)ethane (THPE-BZT) was purchased from Hoechst Celanese Co., Corpus Christi, Tex.

THDI is Desmodur TM N-100, a biuretized hexamethylene diisocyanate available from Mobay Chemical Co.

Evaluation of Stabilizers

Densitometry measurements were made on a custom built computer scanned densitometer and are believed to be comparable to measurements obtainable from commercially available densitometers.

Example 1

A silver halide-silver behenate dry soap was prepared by the procedures described in U.S. Pat. No. 3,839,049. The silver halide totaled 9% of the total silver while silver behenate comprised 91% of the total silver. The silver halide was a 0,055 micron silver bromoiodide emulsion with 2% iodide.

A photothermographic coating (i.e., a silver trip) was prepared as follows:

The following steps were carried out under green safe lights. A photothermographic emulsion was prepared by homogenizing 300 g of the silver halide-silver behenate dry soap described above with 525 g toluene, 1675 g 2-butanone and 50 g poly(vinylbutyral) (B76, Monsanto).

The homogenized photothermographic emulsion (137.25 g) was cooled to 55° F. with stirring. A solution of pyridinium hydrobromide perbromide (PHP, 0.182 g) in methanol (0.697 g) was added and stirred for 2 hours. The addition of a calcium bromide solution (0.128 g) in methanol (0.69 g) was followed by 30 minutes of stirring. Additional poly(vinylbutyral) (31.18 g B-79) was added and stirred for 20 minutes. The mixture was allowed to stand for 16 hours at 55° C.

The following steps were carried out under IR safe lights.

To the stirring mixture was added a mixture of 0.673 g of 2-tribromomethyl-sulfonyl quinaldine in 10.54 g of 2-butanone. After 15 minutes of stirring 5.537 g of Nonox was added followed by 0.421 g of THDI in 0.211 g 2-butanone.

This was allowed to stir for 15 minutes at which time a mixture of 0.107 g of 5-methyl-2-mercaptobenzimidazole (MMBI), 1.204 g of 2-(4-chlorobenzoyl)benzoic acid (CBBA), 0.021 g of Dye 1 in 6.75 g of methanol was added. After 15 minutes, a mixture of 0.232 g tetrachlorophthalic acid and 0.692 g phthalazine were added and allowed to stir for 15 minutes at 55° C.

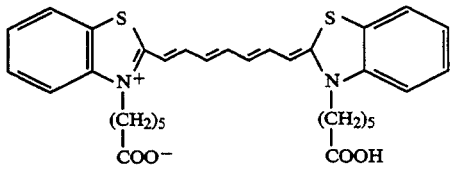

Dye-1

A topcoat solution was coated onto the coated samples prepared above. A master batch of topcoat solution was prepared by mixing: 703 mL 2-butanone, 66.18 g methanol, 51.06 g CAB 171-15S (a cellulose acetate butyrate, Eastman Kodak), 1.723 g 4-methylphthalic acid and 2.12 g Acryloid TM 21 (Rohm and Haas).

Stabilizers in varying concentrations between 0 and 6 mmol/gm topcoat solution were added to 20 g of the master topcoat solution prepared above. The solutions were then placed in a Branson 5200 ultrasound for 20 minutes.

The silver trip and topcoat formulation were dual knife coated. The silver trip was coated at 4.3 mils wet thickness (to give a dry coating weight of 1.81 g/ft$^2$) and the topcoat was coated at 6.0 mils wet thickness (to give a dry coating weight of 0.24 g/ft$^2$) over the silver trip. This was coated onto 3 mil polyester base by means of a dual knife coater and dried for four minutes at 175° F.

The coated film was imaged by exposing with a laser sensitometer (811 nm) with a IR light source. After exposure, the strips (1 inch×7 inches) were processed at 250° F. (121° C.) by heating for 15 seconds in a hot roll processor. The images obtained were evaluated by a computer densitometer. Sensitometric results include Dmin, Dmax and Speed. In these samples, the higher the speed number, the "faster" the film. The sensitometric results shown in Table 1, demonstrate that the compounds of this invention were equal or better than the control for Dmin sensitometric improvements. These samples have a range of Dmin improvements of 24% (6.0 mmol sample) to 19% (0.2 mmol sample) for THPE-BZT (3-Benzotriazol-1',1',1'-tris-(4-hydroxyphenyl)ethane) and of 29% (6.0 mmol sample) to 7% (0.2 mmol sample) for THPE (1',1',1'-tris-(4-hydroxyphenyl)ethane).

TABLE 1

| Compound | Sensitometric Results Dmin | Dmax | Speed* |
|---|---|---|---|
| (7 Days Naturally Aged) | | | |
| (per 100 g of topcoat solution) | | | |
| THPE-BZT | | | |
| (0.0 mmol) | 0.21 | 4.00 | 1.87 |
| (6.0 mmol) | 0.16 | 4.00 | 1.67 |
| (4.0 mmol) | 0.17 | 4.04 | 1.71 |
| (2.0 mmol) | 0.17 | 3.98 | 1.82 |
| (0.2 mmol) | 0.17 | 3.57 | 1.84 |
| THPE | | | |
| (0.0 mmol) | 0.14 | 3.35 | 1.99 |
| (4.0 mmol) | 0.10 | 2.49 | 1.47 |
| (0.8 mmol) | 0.11 | 3.32 | 1.81 |
| (0.2 mmol) | 0.13 | 3.32 | 1.94 |

*Log (1/E) corresponding to density of 1.0 above Dmin.

The 7 day naturally aged samples were used in the testing of print stability. These samples were placed in a controlled heat and light chamber maintained at 45° C. and 25% Relative Humidity. The optical density of the samples were measured on a Macbeth TR924 Densitometer using both the additive blue and visible filters. After 24 hours the samples were removed and measured on the Macbeth TR924 Densitometer. The optical density results for this test are found in Table 2, where ΔDmin=Dmin (Final)−Dmin (Initial).

TABLE 2

| Cpd. Amt. | OPTICAL DENSITY Δ Dmin Additive Blue Filter | Δ Dmin Visible Filter |
|---|---|---|
| (per 100 g of topcoat solution) | | |
| THPE-BZT | | |
| (0.0 mmol) | 0.69 | 0.68 |
| (6.0 mmol) | 0.30 | 0.35 |
| (4.0 mmol) | 0.36 | 0.36 |
| (2.0 mmol) | 0.46 | 0.40 |
| (0.2 mmol) | 0.66 | 0.62 |
| THPE | | |
| (0.0 mmol) | 0.47 | 0.35 |
| (4.0 mmol) | 0.22 | 0.16 |
| (0.8 mmol) | 0.30 | 0.20 |
| (0.2 mmol) | 0.33 | 0.22 |

The decreases in $\Delta D_{min}$ shown above in Table 2 demonstrate that the compounds of this invention are better than the control for print stability improvements. The positive print stability results were observed on all the samples tested. The observed print stability improvements, for example in THPE-BZT were from 56% (6.0 mmol sample) to 4% (0.2 mmol sample) and for THPE were 53% (4.0 mmol sample) to 29% (0.2 mmol sample) better than the control when measured with the additive blue filter.

Example 2

A 13.6 wt % dispersion of silver behenate/behenic acid half soap was made in acetone by homogenization. To 201.5 g of this dispersion was added Butvar B-76 TM (1.12 g) and the mixture was stirred 30 minutes more. Three 1.00 mL aliquots of a solution of 10.0 g zinc bromide in 100.0 mL methanol were added sequentially with stirring for 10 minutes after each addition. Toluene (66.66 g) was added and the mixture was stirred for an additional 15 minutes. A solution (2.40 mL) containing 4.00 g of pyridine in 100 mL methyl ethyl ketone was added with continued stirring for 15 minutes. The mixture was allowed to stand for 4 hours.

To the mixture was added Butvar B-76 TM (31.75 g) and then stirred for 30 minutes followed by the addition of 2.73 mL of a solution of 1.33 g N-bromosuccinimide in 100 mL methanol. CAO-05 TM (4.20 g, an antioxidant purchased from Rohm and Haas Co., Philadelphia, Pa.) was added with stirring for 5 minutes. Acryloid TM 21 (27.22 g, also from Rohm and Haas) was added with stirring for 5 minutes.

The following steps were carried out under green safe lights. A 6.00 mL aliquot of a solution of 0.03 g Dye 2, 25.00 mL methanol, and 75 mL toluene was added and the mixture was stirred for 5 minutes. The viscosity of the resultant solution should be between 180 and 220 centipoise. If greater than 220 centipoise, acetone should be added to bring the viscosity into the appropriate range.

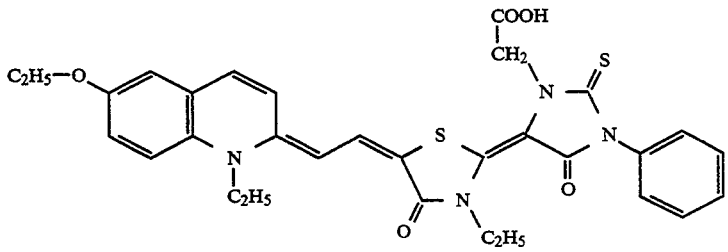

Dye-2

The silver trip formulation was coated at 4.4 mils (112 μm) wet thickness (to give a dry coating weight of 1.25 g/ft$^2$) onto paper and dried at 180° F. for one minute.

A topcoat solution was coated onto the silver trip coated samples prepared above. A master batch of topcoat solution was prepared by mixing: 164.728 g acetone, 82.350 g 2-butanone, 33.300 g methanol, 13.500 g CA 398-6 (a cellulose acetate, Eastman Kodak), 1.542 g phthalazine, 1.068 g 4-methyl-phthalic acid, 0.636 g tetrachlorophthalic acid, and 0.800 g tetrachlorophthalic anhydride. The stabilizer was added to 7.00 g of the master batch topcoat solution before coating. The compound was tested in a dry silver paper topcoat formulation at concentration levels of 4.0, 0.8 and 0.2 mmol/100.00 g of topcoat master batch.

The topcoat formulation was coated at 2.8 mils, wet thickness, on top of the silver emulsion and dried for 3 minutes at 70° C. to provide a dry coating weight of 0.24 g/ft$^2$.

The coated paper was imaged by exposing using a photometric sensitometer with a Eastman Kodak #101 tungsten light source. After exposure, the strips (1 inch×7 inches) were processed at 250° F. (121° C.) by heating for 6 seconds in a hot roll processor. The images obtained were evaluated by a computer densitometer. Sensitometric results include Dmin, Dmax and Speed. In these samples, the lower the speed number, the "faster" the paper. The sensitometric results, shown in Table 3, demonstrate that THPE-BZT is better than the control for Dmin sensitometric improvements. On samples which were naturally aged for 1 week a range of Dmin improvements of 56% (4.0 mmol sample) to 36% (0.2 mmol sample) were observed.

TABLE 3

| Compound Amount | Sensitometric Results Dmin | Dmax | Speed* |
|---|---|---|---|
| (per 100 g of topcoat solution) | | | |
| THPE-BZT | | | |
| (1 Day Naturally Aged) | | | |
| (0.0 mmol) | 0.37 | 1.70 | 0.78 |
| (4.0 mmol) | 0.15 | 1.83 | 1.00 |
| (0.8 mmol) | 0.24 | 1.80 | 0.83 |
| (0.2 mmol) | 0.28 | 1.79 | 0.79 |
| (7 Days Naturally Aged) | | | |
| (0.0 mmol) | 0.39 | 1.79 | 0.86 |
| (4.0 mmol) | 0.17 | 1.83 | 1.06 |
| (0.8 mmol) | 0.24 | 1.81 | 0.90 |
| (0.2 mmol) | 0.25 | 1.79 | 0.87 |

*Log (1/E) corresponding to density of 0.6 above Dmin.

The 1 day naturally aged samples were used in the testing of print stability. These samples were placed in a heat and light chamber controlled to 45° C. and 25% RH. The optical density of the samples were measured on a Macbeth TR924 Densitometer using both the additive blue and visible filters. After 24 hours the samples were removed and measured on the Macbeth TR924 Densitometer. The optical density results for this test are found in Table 4, where ΔDmin=Dmin (Final)−Dmin (Initial).

TABLE 4

| Cpd. Amt. | OPTICAL DENSITY Δ Dmin Additive Blue Filter | Δ Dmin Visible Filter |
|---|---|---|
| (per 100 g of topcoat solution) | | |
| (0.0 mmol) | 1.29 | 0.68 |
| (4.0 mmol) | 0.43 | 0.32 |
| (0.8 mmol) | 0.47 | 0.36 |
| (0.2 mmol) | 0.53 | 0.38 |

The results shown above in Table 4 demonstrate that THPE-BZT in this invention is better than the control for print stability improvements. The positive print stability results were observed on all the THPE-BZT samples tested. The print stability improved as the amount of THPE-BZT was increased in the system. The observed print stability improvements were from 66% (4.0 mmol) to 59% (0.2 mmol) better than the control when measured with the additive blue filter.

Example 3

The same procedure is applied as described in Example 1, except THPE-BZT was added to the photothermographic coating (i.e., silver trip) and not the topcoat layer.

To each of the stabilizers were added 20 g of the silver trip solution prepared above under IR safe lights. The solutions were then hand shaken for 3 minutes each.

A topcoat solution was coated onto the coated samples prepared above. The topcoat solution was prepared by mixing: 703 mL 2-butanone, 66.18 g methanol, 51.06 g CAB 171-15S (a cellulose acetate butyrate, Eastman Kodak), 1.723 g 4-methylphthalic acid and 2.12 g acryloid 21 TM (Rohm and Haas).

The silver trip and topcoat formulation were dual knife coated. The silver trip was coated at 4.3 mils wet thickness (to give a dry coating weight of 1.85 g/ft$^2$) and the topcoat was coated at 6.0 mils wet thickness (to give a dry coating weight of 0.24 g/ft$^2$) over the wet silver trip. This was coated onto 7 mil blue polyester base by means of a dual knife coater and dried for four minutes at 175° F.

The coated film was imaged by exposing with a laser sensitometer (811 nm) with a IR light source. After exposure, the strips (1 inch×7 inches) were processed at 250° F. (121° C.) by heating for 15 seconds in a hot roll processor. The images obtained were evaluated by a computer densitometer. Sensitometric results include Dmin, Dmax and Speed. In these samples, the higher the speed number, the "faster" the film. The sensitometric results shown in Table 5 demonstrate that the compound of this invention is equal or better than the control for Dmin improvements. Samples were naturally aged for 1 week. As seen in Table 5, a range of Dmin improvements of 21% (4.0 mmol sample) to 18% (0.2 mmol sample) were observed.

TABLE 5

| Compound | Sensitometric Results Dmin | Dmax | Speed |
|---|---|---|---|
| (1 Week Naturally Aged) | | | |
| (per 100 g of topcoat solution) | | | |
| (0.0 mmol) | 0.33 | 3.50 | 1.47 |
| (4.0 mmol) | 0.26 | 3.36 | 1.21 |
| (0.8 mmol) | 0.27 | 3.54 | 1.51 |
| (0.2 mmol) | 0.27 | 3.41 | 1.46 |

* Log (1/E) corresponding to density of 1.00 above Dmin.

These samples were placed in a heat and light chamber controlled to 45° C. and 25% RH. The optical density of the samples were measured on a Macbeth TR924 Densitometer using both the additive blue and visible filters. After 24 hours the samples were removed and measured on the Macbeth TR924 Densitometer. The optical density results for this test are found in Table 6, where ΔDmin=Dmin (Final)−Dmin (Initial).

TABLE 6

| Cpd Amt. | OPTICAL DENSITY Δ Dmin Additive Blue Filter | Δ Dmin Visible Filter |
|---|---|---|
| (per 100 g of topcoat solution) | | |
| (0.0 mmol) | 0.52 | 0.44 |
| (4.0 mmol) | 0.18 | 0.17 |
| (0.8 mmol) | 0.37 | 0.23 |
| (0.2 mmol) | 0.39 | 0.34 |

The results shown above in Table 6 demonstrate that the compound of this invention are better than the control for print stability improvements. The positive print stability results were observed on all the THPE-BZT samples tested. The print stability improves as the amount of THPE-BZT is increased. The observed print stability improvements were from 65% (4.0 mmol) to 25% (0.2 mmol) better than the control when measured with the additive blue filter.

Reasonable modifications and variations are possible from the foregoing disclosure without departing from either the spirit or scope of the present invention as defined by the claims.

What is claimed is:

1. A heat-developable, photothermographic element comprising a support bearing at least one photosensitive, image-forming photothermographic emulsion layer comprising:

(a) a photosensitive silver halide;

(b) a non-photosensitive, reducible silver source;

(c) a reducing agent for silver ions;

(d) a binder; and (e) a substituted hydroxyphenyl compound having a nucleus of the formula

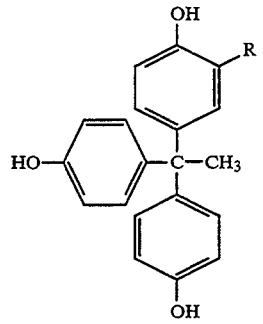

wherein:

R represents hydrogen, benzoyl, a five or six membered heterocyclic ring system, or a fused ring system.

2. A heat-developable, photothermographic element comprising a support bearing at least one photosensitive, image-forming photothermographic emulsion layer comprising:

(a) a photosensitive silver halide;

(b) a non-photosensitive, reducible silver source;

(c) a reducing agent for silver ions;

(d) a binder; and (e) a substituted hydroxyphenyl compound of the general formula

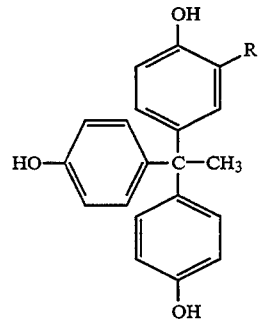

wherein:

R represents hydrogen, benzoyl, a five or six membered heterocyclic ring system, or a fused ring system.

3. The heat-developable, photothermographic element of claim 1 in which R is selected from benzotriazole, benzoxazole, benzothiazole, benzimidizale, pyridine, pyrdidine derivatives, s-triazine, and s-triazine derivatives.

4. The photothermographic element of claim 1 in which the substituted hydroxyphenyl is 3-Benzotriazol-1',1',1'-tris-(4-hydroxyphenyl)ethane.

5. The photothermographic element of claim 1 in which the substituted hydroxyphenyl is 1',1',1'-tris(4-hydroxyphenyl)ethane.

6. The photothermographic element of claim 1 in which the silver halide is selected from silver bromide, silver chloride, silver iodide, silver cholorbromide, silver bromochloride, silver chlorobromoiodide, or mixtures thereof.

7. The photothermographic element of claim 1 in which the non-photosensitive, reducible source of silver is a silver salt of a carboxylic acid having from 1 to 30 carbon atoms.

8. A heat-developable, photothermographic element comprising a support bearing at least one photosensitive, image-forming photothermographic emulsion layer comprising:

(a) a photosensitive silver halide;

(b) a non-photosensitive, reducible silver source;

(c) a reducing agent for silver ions;

(d) a binder; and (e) a substituted hydroxyphenyl compound having a nucleus of the formula

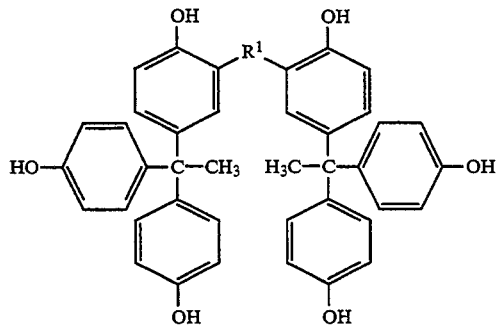

wherein:

$R^1$ represents a disubstituted or a trisubstituted s-triazine group, a disubstituted benz-bis-triazole group, a disubstituted benz-bis-thiazole group, a disubstituted benz-bis-oxazole group, and a disubstituted benz-bis-imidazole group.

* * * * *

UNITED STATES PATENT AND TRADEMARK OFFICE

CERTIFICATE OF CORRECTION

PATENT NO. : 5,370,988

DATED : Dec. 6, 1994

INVENTOR(S) : Manganiello

It is certified that error appears in the above-indentified patent and that said Letters Patent is hereby corrected as shown below:

Column 18, line 36, delete "0,055"
and insert --0.055--.

Signed and Sealed this

Fourth Day of July, 1995

Bruce Lehman

*Attest:*

BRUCE LEHMAN

*Attesting Officer*

*Commissioner of Patents and Trademarks*